US005492291A

United States Patent [19]

Otani

[11] Patent Number: 5,492,291

[45] Date of Patent: Feb. 20, 1996

[54] KEYBOARD FOREARM-WRIST REST

[76] Inventor: Arthur Otani, 25510 Old Course Way, Valencia, Calif. 91355

[21] Appl. No.: 18,702

[22] Filed: Feb. 17, 1993

[51] Int. Cl.[6] ..... B43L 15/00

[52] U.S. Cl. ..... 248/118.1; 248/918

[58] Field of Search ..... 248/118, 118.1, 248/119.3, 118.5, 345.1, 918, 346; 132/73; 400/715

[56] References Cited

U.S. PATENT DOCUMENTS

| | | | |
|---|---|---|---|
| 4,390,011 | 6/1983 | Evans | 248/118.3 X |
| 4,482,063 | 11/1984 | Berke et al. | 248/118 X |
| 4,621,781 | 11/1986 | Springer | 248/118 |
| 4,976,407 | 12/1990 | Schwartz et al. | 400/715 X |
| 5,072,905 | 12/1991 | Hyatt | 248/918 X |
| 5,125,606 | 6/1992 | Cassano et al. | 400/715 X |
| 5,147,090 | 9/1992 | Mandell et al. | 248/118.1 |
| 5,158,257 | 10/1992 | Wilson | 248/918 X |
| 5,183,230 | 2/1993 | Walker et al. | 248/118.3 X |
| 5,188,321 | 2/1993 | Hirschenson et al. | 248/918 X |
| 5,193,925 | 3/1993 | Foulke | 248/118 X |
| 5,240,210 | 8/1993 | Honto, Jr. et al. | 248/118.1 |
| 5,273,250 | 12/1993 | Pemberton et al. | 248/918 |

*Primary Examiner*—Karen J. Chotkowski

[57] ABSTRACT

The keyboard Forearm Wrist Rest is a solitary cushioned, rigid platform that positions the hands and wrists ergonomically in front of the keyboard. The lateral extensions of this solitary platform support the arms in a manner that minimizes damage to the vital structures of the wrists and reduces shoulder fatigue. The basic unit is attached to a rigid sheet which rests upon the workstation, upon which the keyboard, plus central processing unit, and/or monitor are placed. A second embodiment includes a keyboard platform which extends from the basic unit, that can be detached from the workstation proper.

2 Claims, 2 Drawing Sheets

KEYBOARD FOREARM-WRIST REST

BACKGROUND—FIELD OF INVENTION

This invention relates to a rest for the forearm and wrist, specifically to a unique rest which ergonomically supports the upper limb in a manner that minimizes damage to vital structures in the wrist while reducing fatigue when working at keyboards.

BACKGROUND—DESCRIPTION OF PRIOR ART

Uninterrupted typing at keyboards for prolonged periods can lead to pain and swelling of the wrist and hands. This problem is the result of improper support and orientation of the forearm and wrists. The magnitude of this problem is increasing as more efficient computers are used more extensively in the workplace.

The modern keyboard operator has the hands permanently positioned in front of the keyboard for hours on end. Good pianists and typists know that the hands must be kept above the keyboard with the wrists and fingers slightly flexed. Unfortunately, most people can only keep this position comfortably for half an hour or less. Once one becomes fatigued, the palms drop to the base of the keyboard, and the wrists touch the edge of the desk.

The above described situation forces the hands into an extensor deviation, and compresses the vital structures on the volar surface of the wrist. The optional, steeply inclined position offered by most keyboards accentuates this adverse position and forces the hand into hyperextension.

To make matters worse, the previous approaches to mitigating keyboard fatigue included lowering the height of the workstation to just above the lap. This position allowed one to use the arm rests of the chair to relieve some shoulder strain, but amplified the hyperextension of the hands and aggravated the problems associated with traumatizing the vital structures in the wrist.

Swelling and tenderness of the hands could develop from hyperextending the wrists and compressing the vital structures of the carpal tunnel. If one stops at the onset of these symptoms and moves the hands around, these physiological problems resolve without inflicting permanent damage. If one ignores these symptoms and perseveres, then permanent damage to the nerves and other vital structures can occur.

OBJECTS AND ADVANTAGES

Accordingly, several objects and advantages of my invention of the Keyboard Forearm-Wrist Rest are:

(a) to comfortably support the forearms and wrists so that the vital structures in the carpal tunnel will not be compressed, stretched, or traumatized by hyperextension;

(b) to align the distal arm in a manner that positions the hands above the keyboard in a neutral or slightly flexed alignment;

(c) to ergonomically support the forearms and wrists in a plane which bridges the incline from a standard desk top to a chair's armrest;

(d) to distribute the weight of the upper limb over a cushioned platform that will support the load over a large, anatomically padded region of the volar forearms where thick layers of fat and muscle protects the vital structures;

(e) to provide a unique, easily manufactured item that can be added on to existing workstations;

(f) to offer an inexpensive solution to a rapidly growing problem associated with our modern computer oriented society.

Further objects and advantages are to provide a rest that can be built as an integral part of the work station or positioned immediately in front of it. Still further objects and advantages of my invention will become apparent from a consideration of the drawings and the ensuing descriptions of it.

DRAWING FIGURES

REFERENCE NUMERALS IN DRAWINGS

Figure 1:
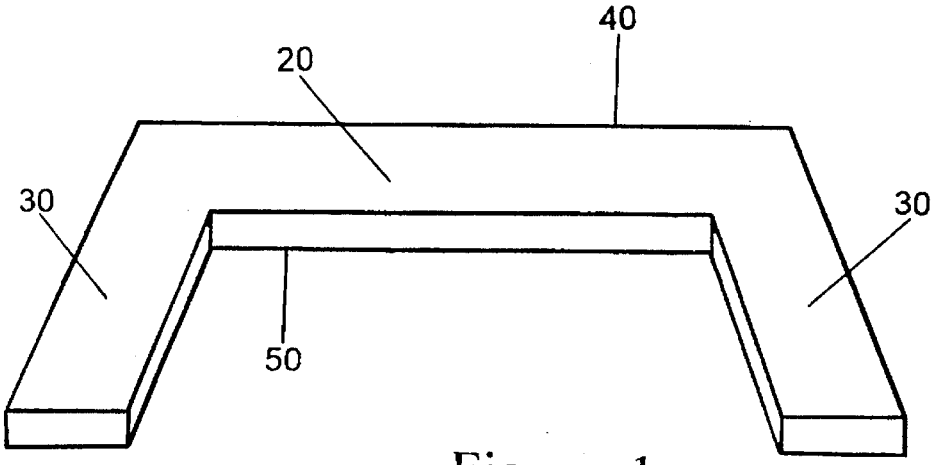
FIG. 1 shows a perspective view of the Keyboard Forearm-Wrist Rest

20 transverse platform
30 lateral platform
40 leading edge
50 trailing edge
60 rigid monitor/CPU sheet
70 attachment device
80 rigid, detachable keyboard sheet
90 detachable attachment device
110 hinge
120 strap
130 leaf spring
140 rigid platform of Keyboard Forearm Wrist Rest
150 rigid platform of work station
160 cushioned pad

DESCRIPTION—FIGS. 1, 2, 3, & 4

A typical embodiment of the Keyboard Forearm-Wrist Rest is illustrated in FIG. 1. The invention consists of a solitary, cushion, rigid platform which includes a transverse platform (20) with a leading edge (40) which is positioned in front of the keyboard. This soft, solitary platform also includes two lateral platforms (30) each extending from a posterior, lateral edge of the transverse component; these lateral components support the forearms, and project backward, straddling the lateral torso of the keyboard user. The anterior torso of the keyboarder rests against the trailing edge (50).

The distance between the lateral platforms (30) is a little less than the width between the armrests of a standard office chair. Different sizes of Keyboard Forearm-Wrist Rests can be manufactured to accommodate people who cannot utilize rests with the standard dimensions.

The Keyboard Forearm-Wrist Rest could be made with a rigid base, overlaid by a soft padding, and wrapped with a smooth cover. This embodiment of the invention utilizes standard furniture manufacturing processes and requires no new tooling or special skills.

A composite variant of the invention could consist of a stratified polymer (plastic), molded into a dense rigid base, a porous intermediate cushion, and a thin, pliable surface covering. This variant, as well as an air, gel, or water inflated embodiments of the invention will require more of an initial tooling investment, but would be less labor intensive, and ultimately, cheaper to manufacture in large quantities.

Figure 4:
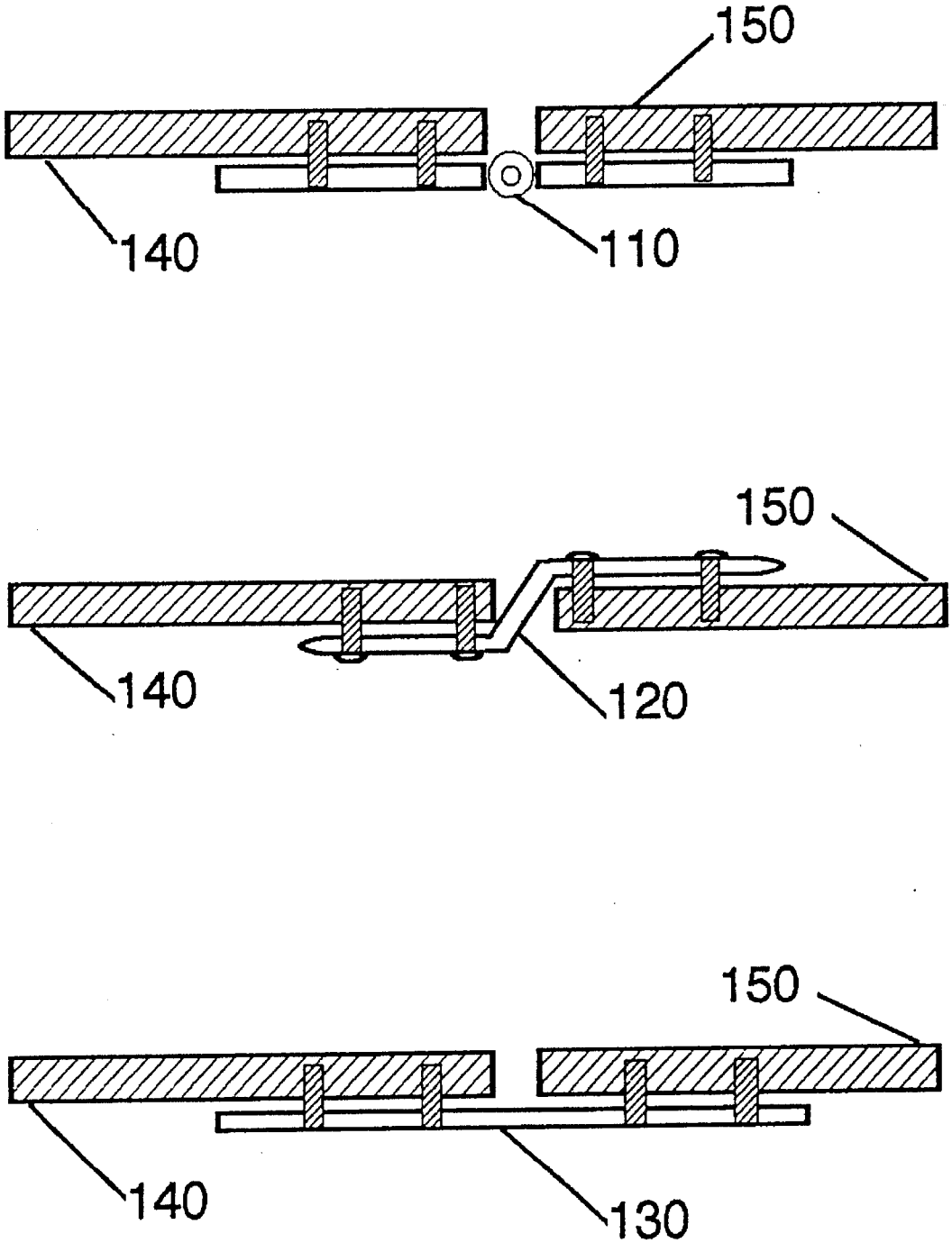
FIG. 4 shows cross-sections of the attachment devices from the group consisting of hinges, straps, and leaf springs

The basic unit of my invention could be secured to a pre-existing workstation with standard attachment devices (70 and FIG. 4) such as hinges (110), straps (120), and leaf springs (130). The straps could be secured to the workstation for permanent installation or could be made with Velcro (or similar temporary fasteners) for removable installation. Hinges could provide a more rigid arrangement and can be of the detachable variety to allow removal of the unit from the workstation proper. These hinges could be spring loaded to keep the platform parallel or perpendicular to the keyboard/workstation when not in use. Both straps and hinges would allow lateral components of the Keyboard Forearm-Wrist Rest to be supported by a chair's armrests, thus providing a strong, stable, but comfortable incline.

Leaf spring could be used in a similar manner, being just strong enough to keep the platform parallel to the work station when not in use. When in use, the weight of the arms would allow the ends of the lateral components of the platform to rest upon the armrests of the chair. Stronger, more rigid leaf springs could be used for chairs without armrests; these stronger leaf springs would deflect downwards a couple inches while supporting the weight of the upper limbs on the Keyboard Forearm Wrist Rest.

Figure 2:
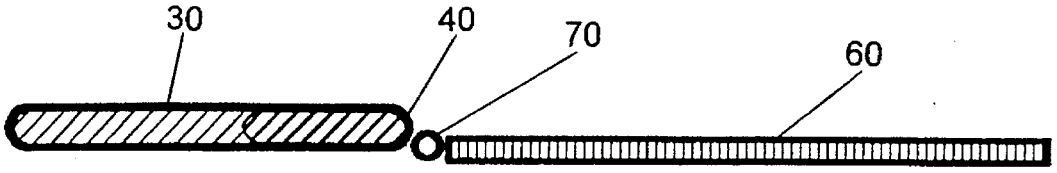
FIG. 2 shows a cross-section of the unit with a rigid monitor/CPU sheet

Another useful arrangement is depicted in cross-section in FIG. 2. It includes a thin, rigid sheet (of metal, plastic, or wood) attached with hinges, straps, or leaf springs to the leading edge of the transverse platform of the Keyboard Forearm-Wrist Rest. The rigid sheet (60) would be large enough to place the keyboard, in front of the monitor and CPU; the combined weight of these components would be heavy enough to hold the keyboard forearm wrist rest in place without nailing, clamping, or screwing the assembly into the desk. This variation would allow the keyboard to be placed directly in front to the monitor on workstations that are too small and, would otherwise require an awkward, side-by-side arrangement of these components.

Figure 3:
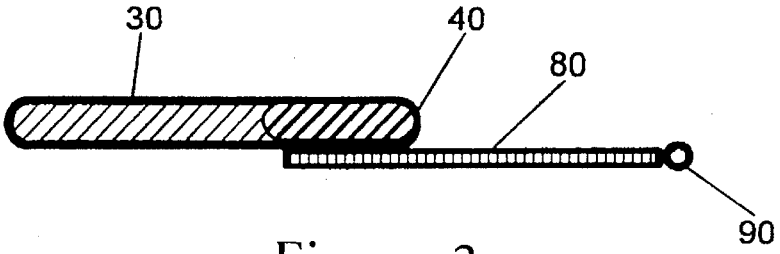
FIG. 3 shows a cross-section of the unit with a rigid, detachable keyboard sheet

FIG. 3 depicts a cross-section of a rigid keyboard sheet (80) attached to the leading edge of the transverse component of the Keyboard Forearm-Wrist Rest. This modification has detachable attachment devices (90) and provides greater flexibility and freedom of movement for keyboarders. This unit allows the keyboard to be used while attached to or detached from the work-station. The detached unit can be used from a chair placed at any angle from the workstation proper; it can even be used from a recliner, wheel chair, or walker. The only limiting factors would be the length of the keyboard cord and the visibility of the monitor.

The preceding discussion relates to methods of securing the Keyboard Forearm-Wrist Rest in front of existing workstations. New computer workstations could incorporate the basic features of this invention into the keyboard platform or the keyboard proper.

From the description above, a number of advantages of the Keyboard Forearm-Wrist Rest become evident:

(a) A variety of embodiments can be made to accommodate pre-existing workstations. These units will enhance, rather than replace costly computer furniture.

(b) The invention can be manufactured easily, by existing furniture makers, with no new tools or unusual skills; hence, the initial investment for production will be minimal, and the product can be introduced rapidly.

(c) The keyboard Forearm-Wrist Rest is a functionally unique, relatively inexpensive, aesthetically pleasing solution to a new, but rapidly growing problem of the computer age.

OPERATION

The Keyboard Forearm-Wrist Rest is used as follows. The basic unit is secured to a work-station, immediately in front of the keyboard. The attachment devices would allow the distal portion of the lateral components to descend until they rest upon the armrests of a chair. If the chair lacks armrests, then leaf spring attachment devices could be used; the weight of the upper limb would produce a comfortable downward deflection until load is equilibrated with upward support from the leaf spring.

The same principles apply when the basic unit is attached to a rigid sheet. This arrangement is stabilized on the surface of the work-station by the weight of the computer's central processing unit, monitor, and keyboard. On small workstations, the rigid sheet can project beyond the edge of the table or desk; this arrangement will be more ergonomic since it will allow the keyboard to be situated directly in front of the monitor, rather than to the side of it.

Under normal circumstances, the Keyboard Forearm-Wrist Rest will also allow the shoulders to relax with the upper arms in mild Abduction and with the elbows in comfortable flexion. This configuration not only supports and protects the distal limb, but it also reduces shoulder fatigue.

The angle formed by the dorsal (back) surfaces of the forearm and the hand around the wrist joint is critical. The invention forces the user to maintain a comfortable, 170 degree or larger angle between the forearm and hand. This is the ideal angle that typing instructors and piano teachers encourage, and which most, well trained people use when starting fresh. The Keyboard Forearm-wrist Rest not only prevents the stretching of the vital structures of the wrist (by maintaining a wrist angle of 170 degrees or more), but it also supports the weight of the upper limb over the large, thickly padded, fleshy area of the forearm. The invention interposes a soft, external cushion (of the rest), plus the biological masses of adipose tissue (subcutaneous fat) and muscle (the brachioradialis and flexor digitorum), between any hard surface and the vital structures of the forearm.

SUMMARY, RAMIFICATIONS, AND SCOPE

Accordingly, the reader will see that the Keyboard Forearm-Wrist Rest protects the vital structures of the wrist while aligning the hands and fingers in a functionally optimal position. It does this in a manner that comfortably supports the upper limb, thus reducing shoulder fatigue.

It is an easily manufactured item that provides an inexpensive solution to a rapidly growing problem associated with prolonged sessions at computer terminals. The various embodiments of the invention provide feasible alternatives for any workstation.

Although the description above contains many specificities, these should not be construed as limiting the scope of the invention, but merely providing illustrations of some of the presently preferred embodiments of this invention.

Thus the scope of the invention should be determined by the appended claims and their legal equivalents, rather than by the examples given.

I claim:

1. An article of furniture for supporting the wrists and forearms ergonomically, in front of a workstation, comprising:

(a) a solitary, cushioned, rigid platform, with a transverse component, and two lateral components, each extending away from a posterior and lateral edge of said transverse component, (b) said platform is attached along the leading edge of said transverse component, with attachment devices, selected from the group consisting of hinges, straps, and leaf springs, to a rigid sheet that rests on the work-station, upon which the keyboard, monitor, and computer are placed.

2. A dual purpose article of furniture for supporting the wrists and forearms ergonomically, in front of a keyboard, comprising:

(a) a solitary, cushioned, rigid platform, with a transverse component, and two lateral components, each extending away from a posterior and lateral edge of said transverse component, (b) with a rigid sheet, large enough to accommodate a keyboard, projecting from the leading edge of said transverse component, (b) the free edge of said rigid sheet being secured to a work-station with removable attaching devices, selected from the group of hinges, straps, and leaf springs, so the unit can be used attached to or detached from the work-station.

* * * * *